US008120550B2

(12) United States Patent
DiSanto et al.

(10) Patent No.: US 8,120,550 B2
(45) Date of Patent: Feb. 21, 2012

(54) EDGE EMISSION ELECTRON SOURCE AND TFT PIXEL SELECTION

(75) Inventors: Frank J. DiSanto, North Hills, NY (US); Denis A. Krusos, Lloyd Harbor, NY (US)

(73) Assignee: Copytele, Inc., Melville, NY (US)

( * ) Notice: Subject to any disclaimer, the term of this patent is extended or adjusted under 35 U.S.C. 154(b) by 1214 days.

(21) Appl. No.: 11/499,841

(22) Filed: Aug. 4, 2006

(65) Prior Publication Data

US 2007/0030216 A1 Feb. 8, 2007

Related U.S. Application Data

(60) Provisional application No. 60/705,654, filed on Aug. 4, 2005.

(51) Int. Cl.
*G09G 3/20* (2006.01)

(52) U.S. Cl. ..... 345/75.2; 345/76; 345/82; 315/169.1; 362/600

(58) Field of Classification Search ..... 345/75.2; 315/169.1
See application file for complete search history.

(56) References Cited

U.S. PATENT DOCUMENTS

| | | | | |
|---|---|---|---|---|
| 5,541,478 | A * | 7/1996 | Troxell et al. | 313/497 |
| 5,717,287 | A * | 2/1998 | Amrine et al. | 313/495 |
| 5,736,814 | A * | 4/1998 | Kinoshita et al. | 313/495 |
| 7,088,346 | B2 | 8/2006 | Krajewski et al. | |
| 7,545,090 | B2 * | 6/2009 | Han et al. | 313/495 |
| 2001/0004190 | A1 * | 6/2001 | Nishi et al. | 313/506 |
| 2007/0031097 | A1 | 2/2007 | Heikenfeld et al. | |
| 2007/0138946 | A1 | 6/2007 | Cok | |
| 2007/0201246 | A1 | 8/2007 | Yeo et al. | |
| 2008/0062373 | A1 | 3/2008 | Kim et al. | |

* cited by examiner

*Primary Examiner* — Ke Xiao
(74) *Attorney, Agent, or Firm* — Office of Carl Giordano, PA

(57) ABSTRACT

The present invention relates to a display device that employs edge emitters as a source for pixel electrons. The edge emitters allow the viewing glass plate to be made very small or eliminated, thereby substantially reducing the size of or eliminating the spacers typically utilized in conventional display devices and thereby enabling a simple and compact assembly structure. In one embodiment a pixel configuration comprises a phosphor area disposed between a plurality edge emitters, each of which are associated with tynes that are adapted to reduce the distance between the emitters and that separate the phosphor area into segments such that the emitters emit electrons when the voltage between a phosphor segment and the an emitter exceed a threshold voltage to cause the phosphor segment to emit light.

18 Claims, 6 Drawing Sheets

EDGE EMISSION ELECTRON SOURCE AND TFT PIXEL SELECTION

RELATED APPLICATIONS

This application claims the benefit under 35 U.S.C. 119 (e) of U.S. Provisional Application Ser. No. 60/705,654 filed Aug. 4, 2005.

FIELD OF THE INVENTION

This application is related to the field of displays and more specifically to edge emission displays using Thin Film Transistor (TFT) technology.

BACKGROUND OF THE INVENTION

Flat panel display (FPD) technology is one of the fastest growing technologies in the world with a potential to surpass and replace cathode ray tubes (CRTs) in the foreseeable future. As a result of this growth, a large variety of FPDs exist, which range from very small virtual reality eye tools to large TV-on-the-wall displays.

Various types of displays exist, such displays utilizing both hot and cold cathodes that produce electrons that activate phosphor. Typically a hot source of electrons consists of a heated filament which causes thermionic emission of the electrons. Such a technique is well known to one of ordinary skill in the art, but has a number of disadvantages. For example, heating of the filament requires considerable power to be expended and represents a significant factor in the overall power required for the display. Furthermore, using a hot source of electrons makes fabrication of a large display difficult because the filament must be supported in a manner that will not be detrimental to cooling of the filament at its respective support locations. Furthermore, since the filament undergoes changes in its physical dimensions when heated, a structure capable of accommodating such a physical change is also required. This further adds to the difficulty and complexity associated with large display device fabrication.

Cold sources of electrons are typically achieved in a vacuum and may be formed in various configurations. Such configurations include spindt, nanotube, and electric field emission via low work function materials.

It would be desirable to obtain an emission source operable in conjunction with a TFT matrix to produce an efficient and relatively simple display device that requires less power and whose construction does not significantly limit the size of the display.

SUMMARY OF THE INVENTION

The present invention utilizes electron source edge emission in conjunction with a TFT matrix to produce an efficient and relatively simple display device. In accordance with embodiments of the present invention, the source of electrons requires very little power and the structure of the device does not limit the size of the display. This structure may be formed using a standard masking procedure to achieve the desired results. Furthermore, any spacing between the glass plate which supports the TFT structure and the electron source and the viewing glass plate may be made very small, thereby substantially reducing the size of the spacers typically utilized in conventional display devices and thereby enabling a very simple and compact assembly structure.

In another embodiment of the present invention a pixel configuration comprises a phosphor area disposed between a plurality of emitters, whereby each of the emitters is associated with one of a plurality of tynes that are adapted to reduce the distance between the emitters and also separate the phosphor area into segments such that the emitters emit electrons when the voltage between a phosphor segment and an emitter exceeds a threshold voltage causing the segment to emit light.

Figure 1:
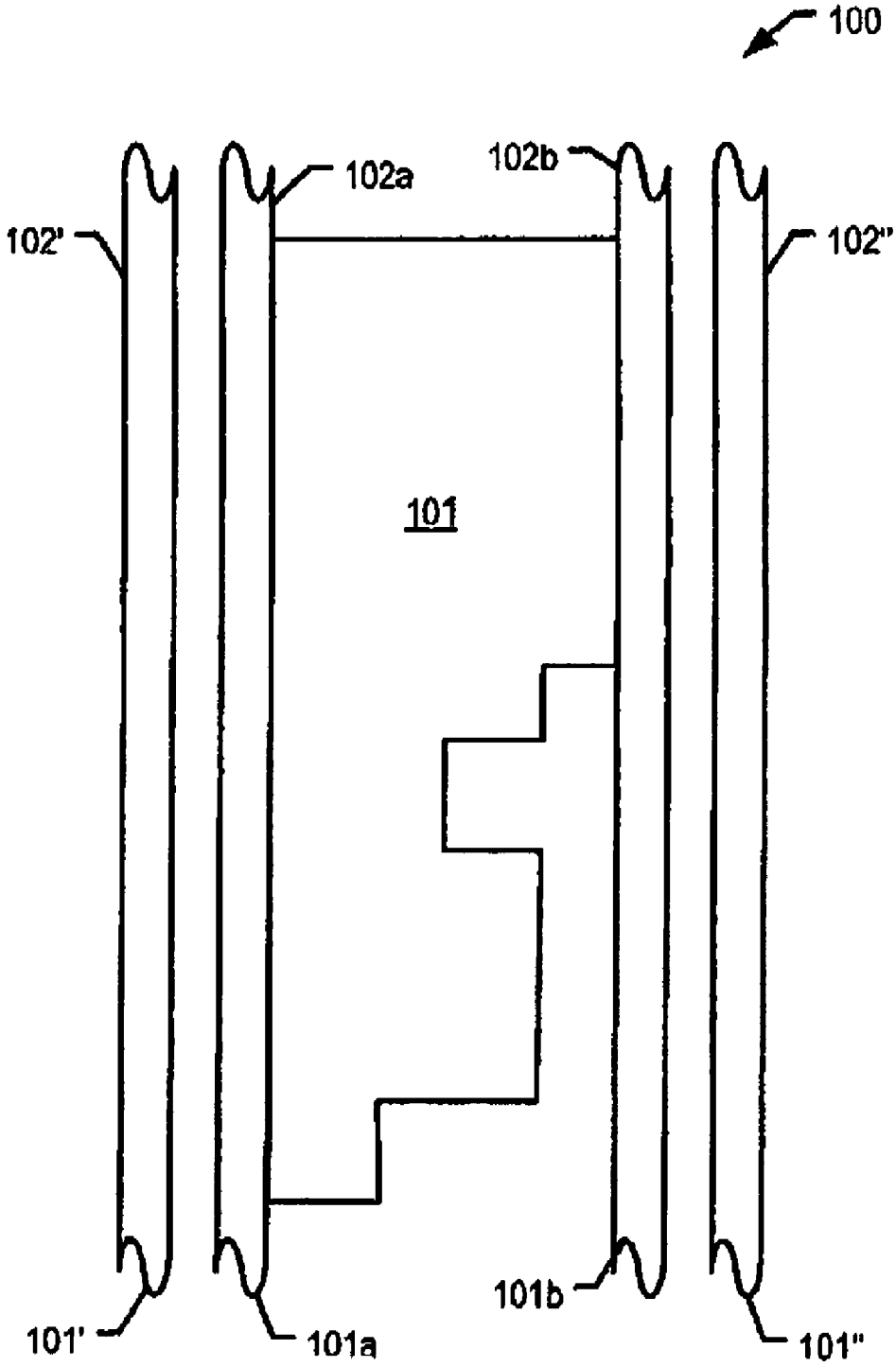
FIG. 1 illustrates an exemplary edge emission electron source on a TFT matrix forming a pixel structure according to an embodiment of the present invention.

It is to be understood that these drawings are solely for purposes of illustrating the concepts of the invention and are not drawn to scale. The embodiments shown herein and described in the accompanying detailed description are to be used as illustrative embodiments and should not be construed as the only manner of practicing the invention. Also, the same reference numerals, possibly supplemented with reference characters where appropriate, have been used to identify similar elements.

DETAILED DESCRIPTION OF THE PREFERRED EMBODIMENTS

FIG. 1 illustrates a plan view of a single pixel configuration 100 having an edge emission source according to an embodiment of the present invention. The pixel structure comprises phosphor area 101 interposed between oppositely disposed emitter bus 101*a* and emitter bus 101*b*. While a single pixel structure is illustrated in FIG. 1, it is understood that a display may be comprised of a number of pixels arranged in abutting or adjacent fashion in a matrix configuration, as is understood by one of ordinary skill in the art. Reference numerals 101', 102' illustrate a portion of a corresponding edge emitter configuration associated with an adjacent pixel to the left of pixel 100, while reference numerals 101", 102" illustrate a portion of a corresponding edge emitter configuration associated with an adjacent pixel to the right of pixel 100. For pixel 100, and for each of the corresponding pixels that comprise a display device, emitter buses 101*a*, 101*b* has a corresponding edge emitter 102*a*, 102*b* for emitting electrons via edge emission. When the voltage between phosphor area 101, and emitter edges 102*a*, 102*b* exceeds a given threshold voltage, the emitter edge operates to emit electrons. The current generated is an exponential function of the voltage between phosphor area 101 and emitter edge 102*a*, 102*b*. The emitter buses

101*a*, 101*b* preferably comprises a low work function material for enabling a low voltage to result in electron emission and hence, a current to flow. Each pixel generates a current to excite the phosphor independent of all other pixels. The voltage on each pixel is controllable independently by a corresponding 1 FT structure (FIG. 7) for each pixel.

Figure 2:
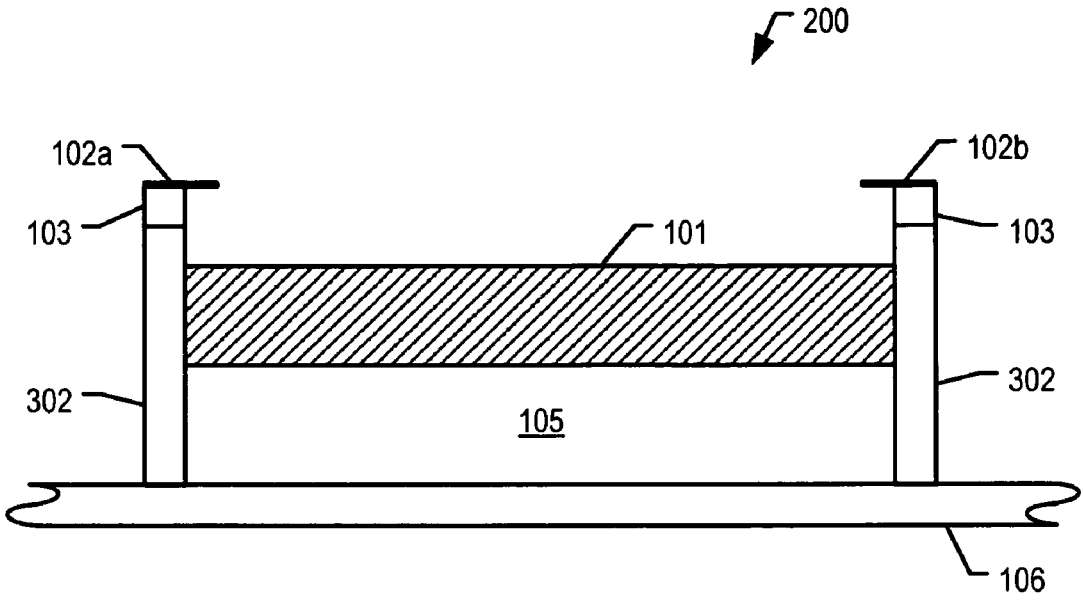
FIG. 2 illustrates an end view of the pixel structure shown in FIG. 1.

FIG. 2 illustrates an end view 200 of the single pixel configuration 100 shown in FIG. 1. As illustrated, the edge emitter bus structures 102*a*, 102*b* are disposed over substrate 106, which in a preferred embodiment comprises a glass substrate. Phosphor area 101 is disposed over pixel reflector 105 formed on the top surface of glass substrate 106 and disposed between the edge emitters. The edge emitters 102*a*, 102*b* extend a predetermined vertical distance beyond the plane of phosphor layer 101. In the exemplary embodiment, the pixel structure further includes insulators 302 disposed on substrate 106 and supporting edge emitters 102*a*, 102*b*, with a conductor 103 disposed there-between. Edge emitters 102*a*, 102*b* are disposed on conductor 103 and extend there from for providing edge emission. In an exemplary embodiment, edge emitters 102*a*, 102*b* may comprise a 500 angstrom (A) layer of Molybdenum (Mo) having a layer of carbon thereover (such as SP2 or SP3 carbon), while conductor 103 may comprise a 0.2 micrometer (um) thick Chromium (Cr) material. Pixel reflector 105 may comprise a metal such as MoCr, Al or ITO, and is disposed upon glass substrate 106.

Figure 3:
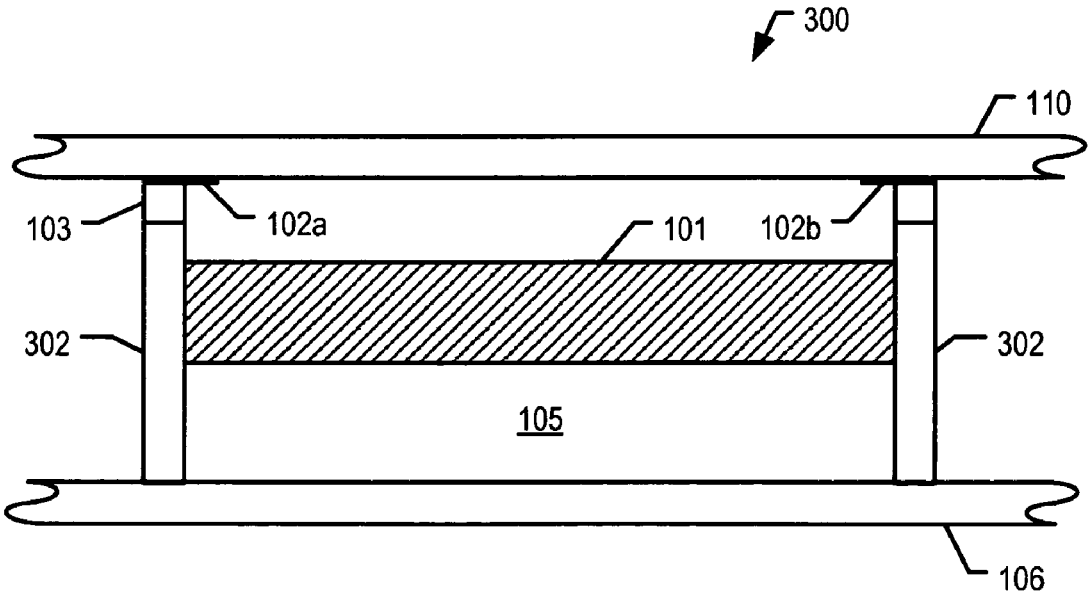
FIG. 3 illustrates an end view of an assembled display incorporating the pixel structure of FIG. 1.

FIG. 3 illustrates an end view of a single pixel assembled as part of display 300 and comprises oppositely disposed glass substrates 106 and 110, and pixel reflector 105, and phosphor area 101 between a pair of oppositely disposed edge emitters 102*a*, 102*b*. The display device and pixel structures illustrated in FIG. 3 (and in FIG. 5) may be assembled via a machine in a vacuum chamber so as to obtain a proper evacuation for enabling proper functioning of the display device.

Figure 4:
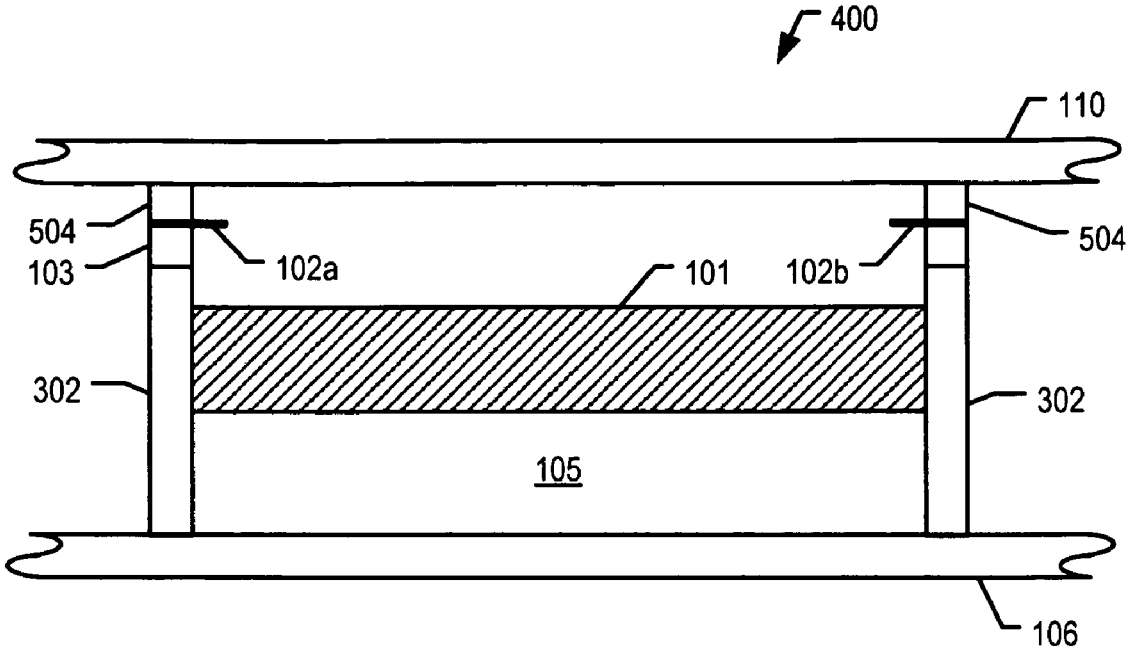
FIG. 4 illustrates an end view of an assembled display incorporating the pixel structure of FIG. 1 and further including spacers disposed between the TFT assembly and the front viewing glass.

FIG. 4 illustrates an end view of a single pixel assembled display 400 similar to that of FIG. 3, but further including spacers 504 disposed between the viewing glass substrate 110 and the edge emitters 102*a*, 102*b*. The spacers may be formed of an insulator such as SU-8 and have a thickness of about thirty (30) microns or less (SU-8 is a commercial negative-tone photoresist supplied by MicroChem Corp. of Newton, Mass.). In the embodiment illustrated in FIG. 4, the device may be evacuated with or without resort to a vacuum chamber due to the spacers that enable a tube to be inserted therein and evacuating the display device.

Figure 5:
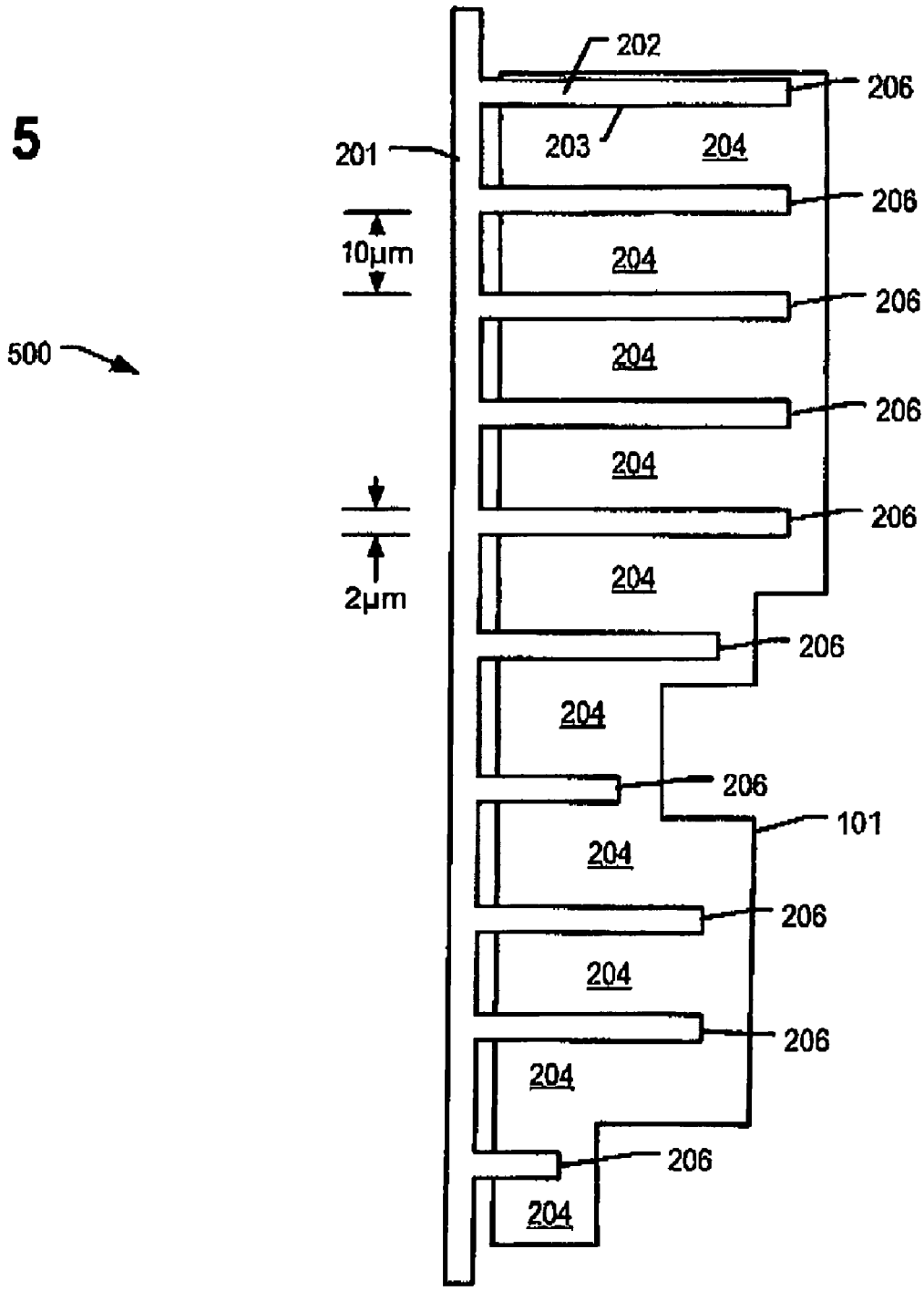
FIG. 5 illustrates an edge emission electron source on a TFT matrix forming a pixel structure utilizing multiple tynes as edge emitters according to another embodiment of the present invention.

FIG. 5 illustrates a plan view of an alternative single pixel structure 500 according to an embodiment of the present invention. Pixel structure 500 includes a phosphor area 101 separated by imposition of a plurality of tynes 206 joined by a common bus 201, wherein each tyne 206 is associated with a corresponding emitter 202. Emitter edges 203 emit electrons when the voltage between phosphor segments 204 and emitter edges 203 exceeds a threshold voltage. The current generated is an exponential function of voltage between the segments 204 of phosphor 101 and emitter edges 203. The distance between each corresponding phosphor segment 204 is thereby reduced by the imposition of the tynes 206, thus enabling a smaller voltage than, as for example, required in FIG. 1 configuration 100, to be used to cause electron current to flow. The use of tynes 206 also allows a reduced vertical distance between the emitter edges 203 and the phosphor areas 101. Recall in reference to FIG. 2, that the edge emitters extend a predetermined vertical distance beyond the plane of phosphor layer 101. Conversely, the reduced distance between each phosphor segment 204 and the emitter edge 203 serves to increase the field strength of the emitter edge 203, thereby reducing the potential voltage between the emitter edge 203 and the phosphor segment 204 to obtain the current or electron stream required for the pixel to emit light.

In one configuration, where the width of the phosphor area 101 is about 100 μm, each of the phosphor segments 204 may have a width of about 10 μm, with each tyne having a width of about 2 μm. Thus, the active area of such a pixel structure is about 80% of the full pixel area, however, the multiple tynes 206 embodiment also produces a more uniform illumination of the phosphor compared to the prior art. In the exemplary embodiment depicted herein, the tyne 206 structures are each of uniform width and are separated from one another by a substantially uniform distance. The height or length of the tyne 206 structures may vary, however, according to the overall shape of the entire phosphor area. 101. In one non-limiting embodiment of the invention, the pixel structure 500 comprises a phosphor area 101 disposed between a plurality emitters 202, where each of the emitters 202 is associated with one of a plurality of tynes 206 that are adapted to reduce the distance between the emitters 202 and that additionally separate the phosphor area into a plurality of phosphor segments 204. When the differential voltage between a phosphor segment 204 and the emitter edge 203 potential exceed a threshold voltage, emitters 202 emit electrons causing the phosphor segment 204 to emit light.

While the illustrated embodiment of FIG. 5 shows horizontally oriented tyne 206 structures, it is of course understood that the present invention may be embodied in a vertically oriented tyne structure as well.

Figure 6:
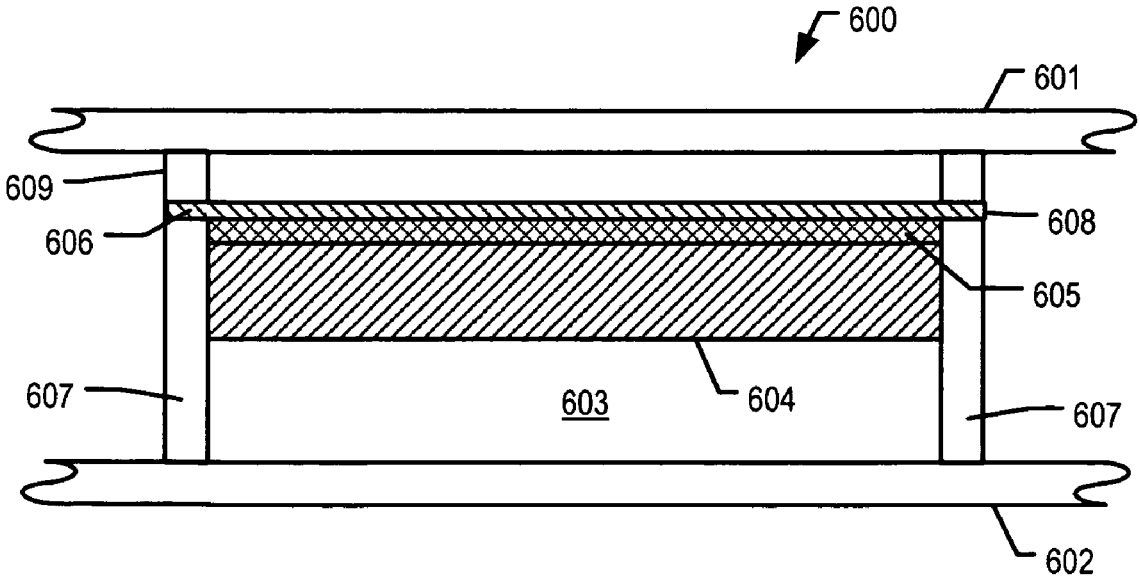
FIG. 6 illustrates an end view of a pixel structure shown in FIG. 5 according to an embodiment of the present invention.

FIG. 6 illustrates the end view 600 of the single pixel configuration shown in FIG. 5. This configuration again includes phosphor area 604 comprised of a series of phosphor segments separated by emitter tynes 606. The configuration further includes top and bottom glass substrates 601 and 602. A pixel reflector metal 603 is disposed on the bottom glass substrate 602. Insulators 607 extend between substrate 602 and tynes 606. And, a spacer insulator 609 extends between tynes 606 and substrate 602. An insulator 605 isolates tynes 606 from phosphor 604. A conductor 608 is electrically coupled to tynes 606. In an exemplary. configuration, conductor 608 comprises 0.2 μm Cr while emitter tynes 606 may be a material such as a 500 A thick layer of Mo having a carbon material (such as SP2 or. SP3 carbon) disposed thereon. Pixel metal 603 may be formed of MoCr, Al, ITO or other such types of metals.

The configurations illustrated in the various embodiments of the present invention may be used with a thin flat CRT assembly or a VFD assembly, or any other display which utilizes electrons or other charged particles.

According to an embodiment of the present invention, a TFT circuit may be provided to drive the metal layer (reference numeral 105 in FIG. 2, or reference numeral 603 in FIG. 6, for example) coupled to the phosphor layer 103 to cause emission from the emitter 104 (FIG. 2) to change color and cause the phosphor to change its brightness. In a cold cathode configuration as depicted herein, the phosphor is in contact with one of the elements that cause the cathode to emit electrons. Accordingly, if the metal layer 105 is positively charged, then the edge emitter is negatively charged relative to the metal in order for electron emission to occur. As is understood by one of ordinary skill in the art, controlled changes in voltage applied to the pixel reflector metal 105 enables one to obtain a grey scale for display onto the display device formed via the matrix array of pixel structures embodied in the present invention.

Figure 7:
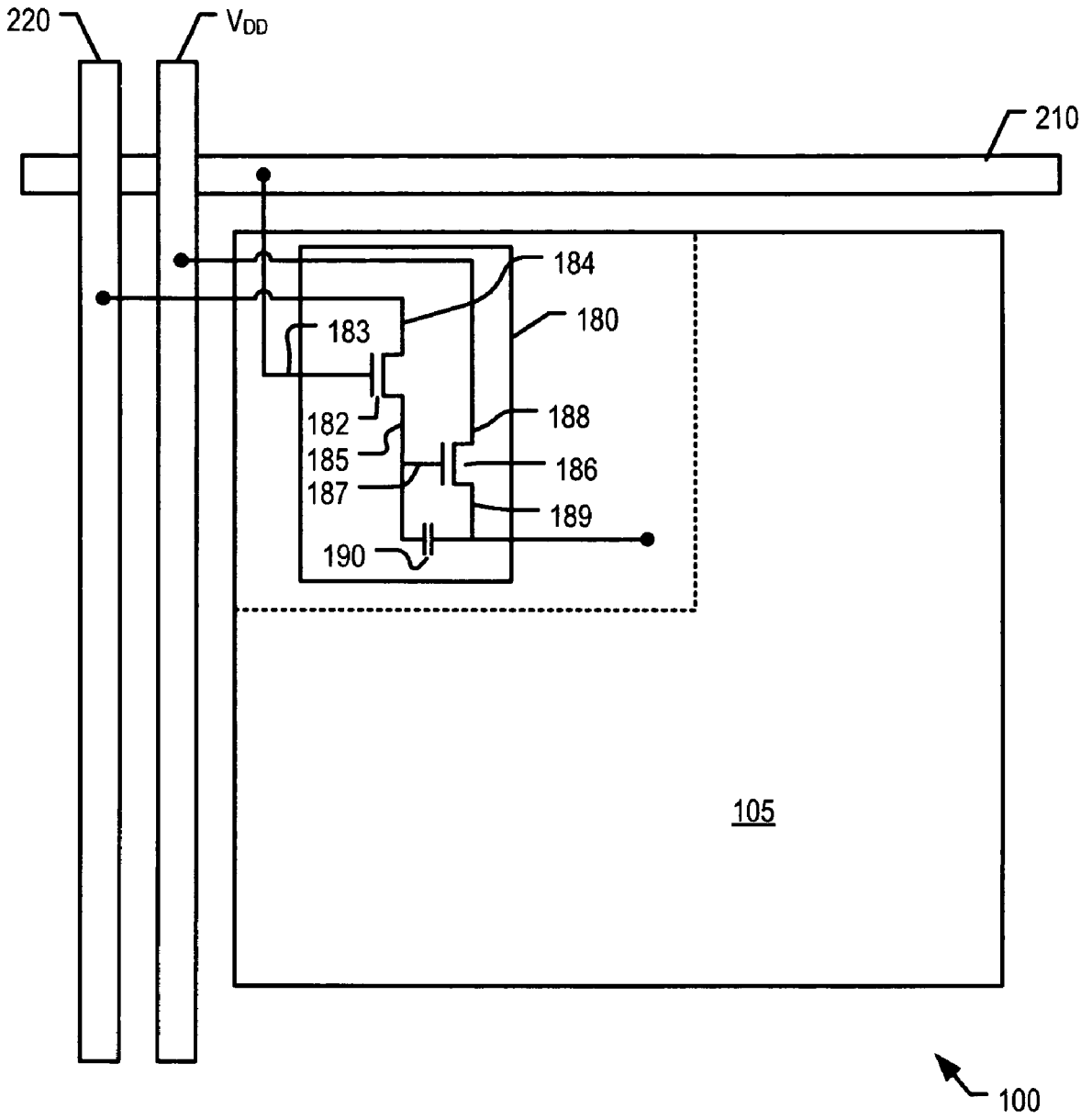
FIG. 7 illustrates a TFT circuit for driving a pixel structure formed in accordance with the principles of the present invention.

Referring now to FIG. 7 in conjunction with FIG. 2, there is associated with each pixel element a TFT circuit 180 that is operable to apply a known voltage to an associated phosphor layer pixel element. TFT circuit 180 operates to apply either a first voltage to bias an associated pixel element to maintain it in an "off" state or a second voltage to bias an associated pixel element to maintain it in an "on" state, i.e., activate. In one embodiment, TFT circuit 180 may apply a zero voltage, Va=0, to bias pixel metal 105 into an "off" state, or apply a higher positive bias voltage, on the order of Va=25-30 volts, to bias the pixel metal into an "on" state. In this illustrated case, the device is inhibited from emitting electrons from the emitter when in an "off" state, and attracts electrons when in an "on" state. The use of TFT circuitry for biasing the metal provides for the dual function of addressing pixel elements and maintaining the pixel element in a condition to attract electrons for a desired time period, i.e. time-frame or sub-periods of time-frame, for example.

Associated with each pixel metal layer 105 and accessed by a row/column designation is TFT circuit 180. TFT circuit 180 operates to electrically disconnect an associated pixel metal layer when the associated pixel is intended to be in an "off" state and connect an associated pixel metal layer when it is intended to be in an "on" state. A known voltage, referred to as $V_{DD}$, is applied to each TFT circuit 180.

Figure 8:
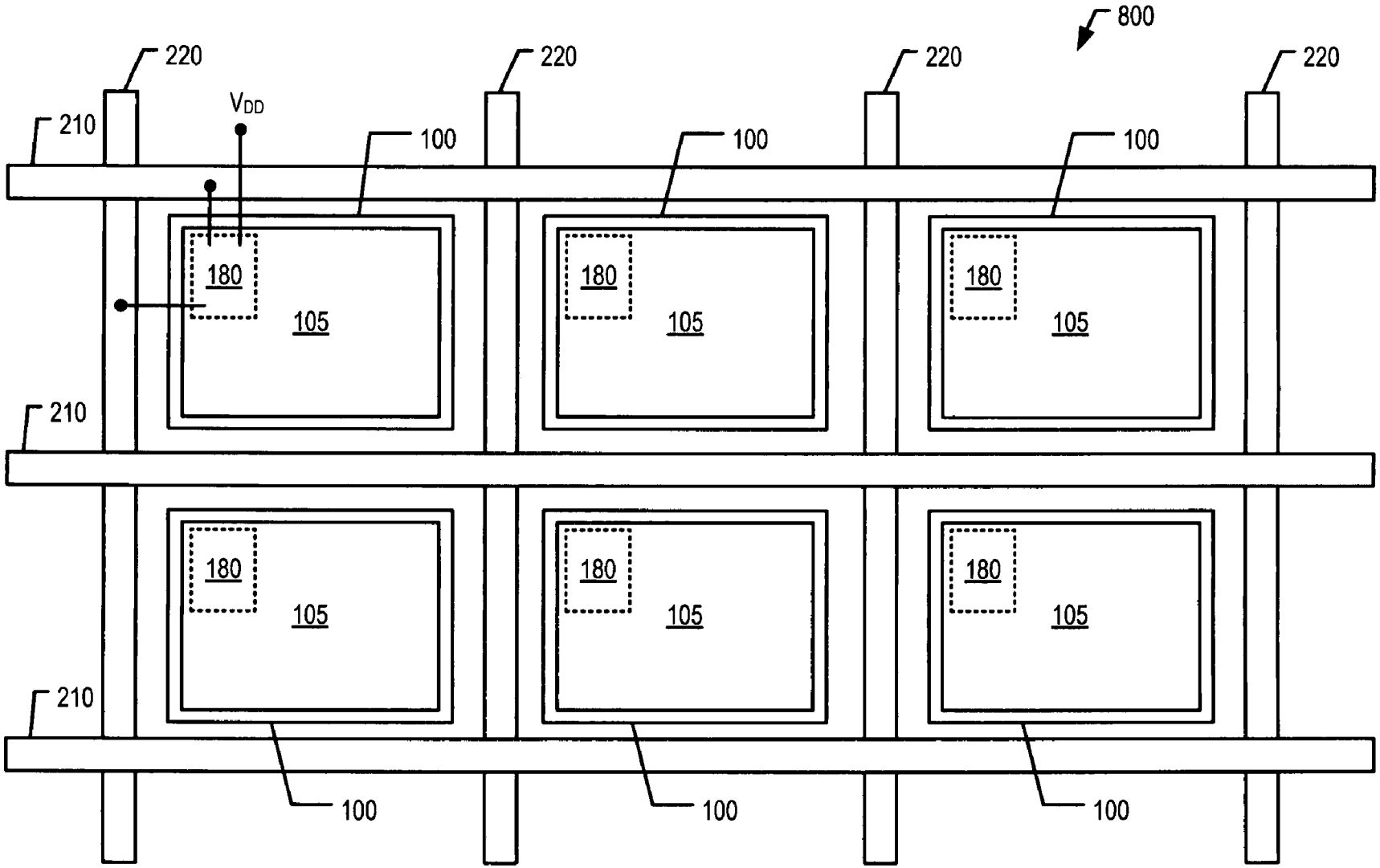
FIG. 8 illustrates a matrix display device formed from the pixel structures in accordance with the principles of the present invention.

FIG. 7 illustrates a circuit diagram of a TFT circuit 180 associated with a single pixel element 100 in a matrix display device 800 depicted in FIG. 8 comprising multiple pixels 100 separated by row conductors 210 and column conductors 220, as is understood by one skilled in the art. In the illustrated embodiment of FIG. 7, pixel metal layer 105 is shown cutaway to reveal the details of TFT circuit 180. TFT circuit 180 is composed of two transistor devices 182, 186, electrically cascaded, and capacitor 190 connected between the output of first device 182 and the output of second device 186. In the illustrated embodiment, devices 182, 186 are FETs (Field Effect Transistors). FETs are known in the art to possess a high input impedance.

In the illustrated embodiment, gate node 183 of FET 182 is electrically connected to and associated with row conductor 210, and node 184 of FET 182 is associated with column conductor 220. The output node 185 of FET 182 is electrically cascaded to gate electrode 187 of FET 186, and to capacitor 190.

Electrode 188 of FET 186 is electrically connected to a constant voltage source, typically $V_{DD}$, and output electrode 189 is electrically connected to an electrically conductive pad. Capacitor 190 is also further connected between the gate and the source nodes of FET 186.

In operation, when FET 182 is in an "on" state, by the application of a voltage on row conductor 210, a voltage applied to column line 220 is passed through FET 182 and concurrently present at, or applied to, gate node 187 of FET 186 and capacitor 190. Capacitor 190 is charged to substantially the same voltage value as applied to column 220. When voltage on row line 210 is removed, capacitor 190 operates to substantially maintain the same potential as is on column line 220 to gate electrode 187. This voltage is maintained for a known period of time, which is based on the value of capacitor 190 and an impedance of FET 182. Capacitor 190 thus operates to substantially "hold" the voltage even after the voltage or potential to selected row 210 is removed.

Thus, TFT circuit 180 provides for both "pixel selection" and "pixel hold" functions. Accordingly, electrons may continue to be attracted to the corresponding phosphor layer for a desired time frame without the concurrent application of a voltage on a corresponding row conductor.

The drive circuit may be implemented as a source follower configuration (in the active region of the FET), wherein the pixel voltage corresponds to the gate voltage less the threshold voltage of the FET. The threshold voltage corresponds to the voltage at which the FET begins to conduct. Voltage or potential is applied to gate terminal 187 of FET 186. The pixel voltage is thus the gate voltage less the threshold voltage for FET 186. This enables gray scale operation of the display device. It is of course understood that the display may also be operated without grey scale (i.e. as a black and white device) by applying in a first mode a gate voltage below the threshold (e.g. to obtain black), and in a second mode by applying a voltage equal to or greater than $V_{DD}$ (thereby saturating the transistor to obtain white).

Referring again to FIGS. 1 and 8, one non-limiting embodiment of the invention comprises a flat panel display having the matrix display device 800 wherein each pixel 100 is electrically addressable using a corresponding TFT driver circuit 180 each being electrically coupled to an associated pixel 100, respectively; and at least two edge emitters such as 102*a*, 102*b* adjacent to each associated pixel 100; and, wherein, exciting said edge emitters 102*a*, 102*b* and addressing one of said associated pixel 100 using said associated TFT driver circuit 180 causes said edge emitters 102*a*, 102*b* to emit electrons that induce said one of said pixels 100 to emit light.

While there has been shown, described, and pointed out fundamental novel features of the present invention as applied to preferred embodiments thereof, it will be understood that various omissions and substitutions and changes in the apparatus described, in the form and details of the devices disclosed, and in their operation, may be made by those skilled in the art without departing from the spirit of the present invention. It is expressly intended that all combinations of those elements that perform substantially the same function in substantially the same way to achieve the same results are within the scope of the invention. Substitutions of elements from one described embodiment to another are also fully intended and contemplated.

What is claimed is:

1. A flat panel display comprising:

a plurality of electrically addressable pixels;

a plurality of thin-film transistor (TFT) driver circuits each being electrically coupled to an associated one of said pixels;

a plurality of substantially perpendicular walls surrounding each of said pixels, said walls being of an insulating material;

a conductive layer positioned on top of at least one of said substantially perpendicular walls, said conductive layer being of a comparable size to said walls; and one or more edge emitters associated with each of said pixels, positioned on top of the conductive layer, wherein each of said edge emitters includes a plurality of substantially parallel elongated portions extending over a portion of said associated pixel;

wherein, exciting said edge emitters, through said conductive layer, and addressing associated ones of said pixels using said associated driver circuits causes said edge emitters to emit electrons that induce corresponding ones of said pixels to emit light.

2. The display of claim 1, wherein said electrically addressable pixels each include a phosphor capable of generating light.

3. The display of claim 1, further comprising a substrate supporting said pixels, TFT driver circuits, and emitters.

4. The display of claim 3, further comprising a transparent viewing glass substrate oppositely disposed from said substrate supporting said pixels, driver circuits and emitters wherein said viewing substrate passes the pixel emitter light.

5. The display of claim 4, further comprising one or more spacers disposed between the viewing glass substrate and the emitters.

6. The display of claim 5, wherein the one or more spacers comprise an insulator having a thickness of less than about thirty micrometers.

7. A flat panel display comprising:

a plurality of electrically addressable pixels;

a plurality of thin-film transistor (TFT) driver circuits each being electrically coupled to an associated at least one of said pixels, respectively;

a plurality of substantially perpendicular walls surrounding each of said pixels, said walls being of an insulating material;

a conductive layer positioned on top of at least one of said substantially perpendicular walls, said conductive layer being of a comparable size to said walls; and a plurality of edge emitters, positioned on said conductive layer, wherein each pixel of said a plurality of pixels is interposed between oppositely disposed edge emitters, and at least some of said edge emitters comprise a plurality of substantially parallel elongate portions extending over a portion of at least one pixel; and wherein, exciting said edge emitters, through said conductive layer, and addressing ones of said pixels using said associated driver circuits causes said edge emitters to emit electrons that induce corresponding ones of said pixels to emit light.

8. The display of claim 7, further comprising a second substrate oppositely disposed from said substrate, wherein said second substrate is transparent and said light is emitted through said second substrate.

9. The display of claim 7 wherein each of said elongated portions comprises a low work function material.

10. The display of claim 7, wherein each of said edge emitters comprises a layer of molybdenum.

11. The display of claim 7, wherein each of said edge emitters comprises a layer of carbon over said layer of molybdenum.

12. The display of claim 7 wherein each of said elongated portions is an emitter bus.

13. The display of claim 1 wherein each of said elongated portions comprises a low work function material.

14. The display of claim 1 wherein each of said edge emitters is a cold source of electrons.

15. The display of clam 2 further comprising a reflector associated with each of said pixels, said phosphor being positioned between said edge emitters and said reflector.

16. The display of claim 1, wherein each of said edge emitters comprises a layer of molybdenum.

17. The display of claim 16 wherein each of said edge emitters comprises a layer of carbon over said layer of molybdenum.

18. The display of claim 1 wherein each of said elongated portions is an emitter bus.

* * * * *